United States Patent [19]

Kuwako et al.

[11] Patent Number: 4,483,606

[45] Date of Patent: Nov. 20, 1984

[54] TONER SCATTERING PREVENTION DEVICE

[75] Inventors: Takashi Kuwako, Okazaki; Takao Fujiwara, Toyokawa, both of Japan

[73] Assignee: Minolta Camera Kabushiki Kaisha, Osaka, Japan

[21] Appl. No.: 458,870

[22] Filed: Jan. 7, 1983

[30] Foreign Application Priority Data

Jan. 22, 1982 [JP] Japan ..... 57-7996[U]

[51] Int. Cl.[3] ..... G03G 15/08

[52] U.S. Cl. ..... 355/3 DD; 355/15; 118/653

[58] Field of Search ..... 355/3 DD, 3 R, 3 CH, 355/14 D, 15; 118/653, 656, 657, 658, 661

[56] References Cited

U.S. PATENT DOCUMENTS

| | | | |
|---|---|---|---|
| 3,085,275 | 4/1963 | Allison | 15/236 |
| 3,848,992 | 11/1974 | Smith | 355/15 |
| 3,918,402 | 11/1975 | Ohta | 118/653 X |
| 4,168,901 | 9/1979 | Ito et al. | 355/3 DD |
| 4,226,524 | 10/1980 | Hashimoto | 355/3 DD |
| 4,304,192 | 12/1981 | Mayer | 118/656 X |
| 4,334,766 | 6/1982 | Sugiyama et al. | 355/15 |

*Primary Examiner*—A. C. Prescott

*Attorney, Agent, or Firm*—Wenderoth, Lind & Ponack

[57] ABSTRACT

A toner scattering prevention device for preventing toner from scattering out of a developing device or a cleaning device. The device includes a toner sealing plate and a clamp arrangement. The clamp arrangement prevents the toner sealing plate from being displaced in a direction at right angles to a widthwise direction of a toner image support member but allows displacement of the toner sealing plate, resulting from expansion or shrinkage of the toner sealing plate in the widthwise direction of the toner image support member due to environmental changes, aging, etc.

6 Claims, 7 Drawing Figures

TONER SCATTERING PREVENTION DEVICE

BACKGROUND OF THE INVENTION

The present invention generally relates to electrography and more particularly, to a toner sealing device or toner scattering prevention device for use in a developing device or a cleaning device of an electrographic copying apparatus and the like.

Generally, prior art electrophotographic copying apparatuses of toner image transfer type have such an inconvenience that, since an opening edge portion of a developing device casing or a cleaning device casing is provided so as to confront a photosensitive or photoreceptor drum (i.e. toner image support member), powdery toner is scattered out of the developing device casing or the cleaning device casing into an apparatus housing, thus resulting in contamination inside the apparatus housing. Accordingly, in the conventional copying apparatuses, it has been so arranged that a base portion of an elastic sealing plate is secured to the opening edge portion of the developing device casing or the cleaning device casing through bonding thereof by the use of a double-coated tape or through depression thereof by the use of a leaf spring, while a tip portion of the elastic sealing plate is brought into light pressing contact with a surface of the photoreceptor drum. However, the known copying apparatuses have such a disadvantage that the elastic sealing plate is inevitably subjected to corrugation or waving during use, thereby resulting in improper sealing of the toner such as scattering of the toner, etc. Namely, the elastic sealing plates of this kind are likely to be subjected to expansion or shrinkage due to environmental changes, aging, etc. Consequently, even if utmost care is taken to prevent formation of corrugations on the elastic sealing plate at the time the elastic sealing plate is secured to the opening edge portion, the sealing plate itself is subjected to expansion or shrinkage due to environmental changes, aging, etc. as described above and thus, the sealing plate is inevitably corrugated at the time of use thereof. For example, in the case where a polyester film measuring 0.05 mm thick, 287 mm long and 20 mm wide is used as the sealing plate, when environmental conditions changed from a temperature of 20° C., and a humidity of 40% r.h. to a temperature of 30° C. and a humidity of 80% r.h., the sealing plate is subjected to an elongation of about 0.18 mm with respect to the length of 287 mm since a coefficient of thermal expansion and a coefficient of moisture swelling of the polyester film are, respectively, $1.5\times10^{-5}$ cm/ cm/ °C. and $1.2\times10^{-5}$ cm/ cm/ % r.h.

SUMMARY OF THE INVENTION

Accordingly, an essential object of the present invention is to provide an improved toner scattering prevention device which is capable of sealing toner stably at all times through prevention of formation of corrugations on an elastic sealing plate due to environmental changes, aging, etc., with substantial elimination of the disadvantages inherent in conventional toner scattering prevention devices of this kind.

Another important object of the present invention is to provide an improved toner scattering prevention device of the above described type which is simple in structure, highly reliable in actual use, suitable for mass production at low cost, and can be readily incorporated into electrographic copying apparatuses and the like at low cost.

In accomplishing these and other objects according to one preferred embodiment of the present invention, there is provided an improved toner scattering prevention device for preventing toner from scattering out of a developing device or a cleaning device, with said developing device and said cleaning device being provided so as to confront a surface of a toner image support member arranged to be driven for rotation, said device comprising:

a toner sealing plate of elastic material, which is brought into light pressing contact with the surface of said toner image support member;

a support member for supporting, on a support face thereof, said toner sealing plate integrally with said developing device or with said cleaning device, with said toner sealing plate extending in a widthwise direction of said toner image support member;

a clamp member for clamping said toner sealing plate, which is formed with a clamp face confronting said support face of said support member, with a clearance between said support face and said clamp face being kept larger than a thickness of said toner sealing plate;

said support face and said clamp face defining therebetween a groove for accommodating said toner sealing plate therein; and a clamp means for clamping said toner sealing plate in said groove, which prevents first displacement of said toner sealing plate in said groove and in a direction at right angles to the widthwise direction of said toner image support member but allows second displacement of said toner sealing plate in said groove, with the second displacement of said toner sealing plate resulting from expansion or shrinkage of said toner sealing plate in the widthwise direction of said toner image support member due to change in an environment surrounding said device.

In accordance with the present invention, since the elastic sealing plate is not subjected to corrugation, toner is positively prevented from scattering out of the developing device or the cleaning device into the apparatus housing at all times.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
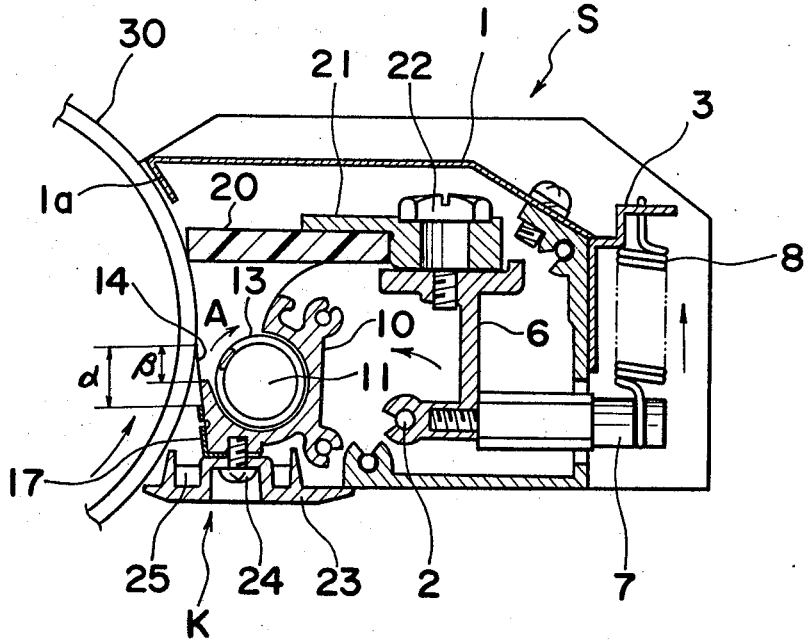
FIG. 1 is a cross-sectional view of a cleaning device into which a toner scattering prevention device according to a first embodiment of the present invention is incorporated.
Figure 2:
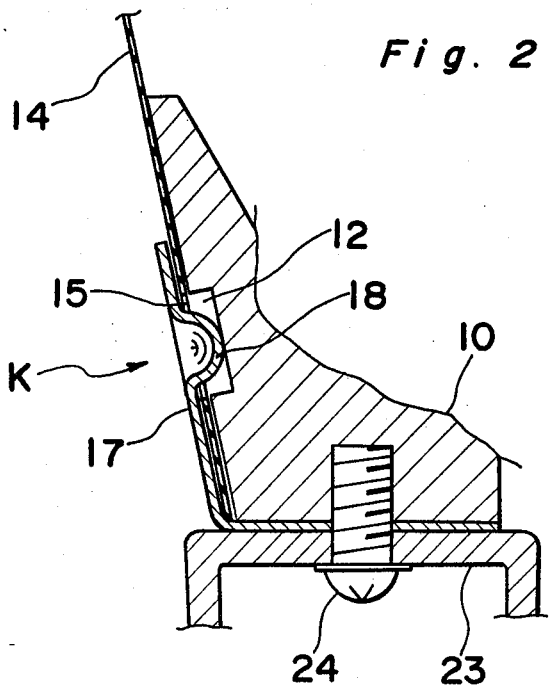
FIG. 2 is a cross-sectional view showing, on an enlarged scale, a main portion of the toner scattering prevention device of FIG. 1.
Figure 3:
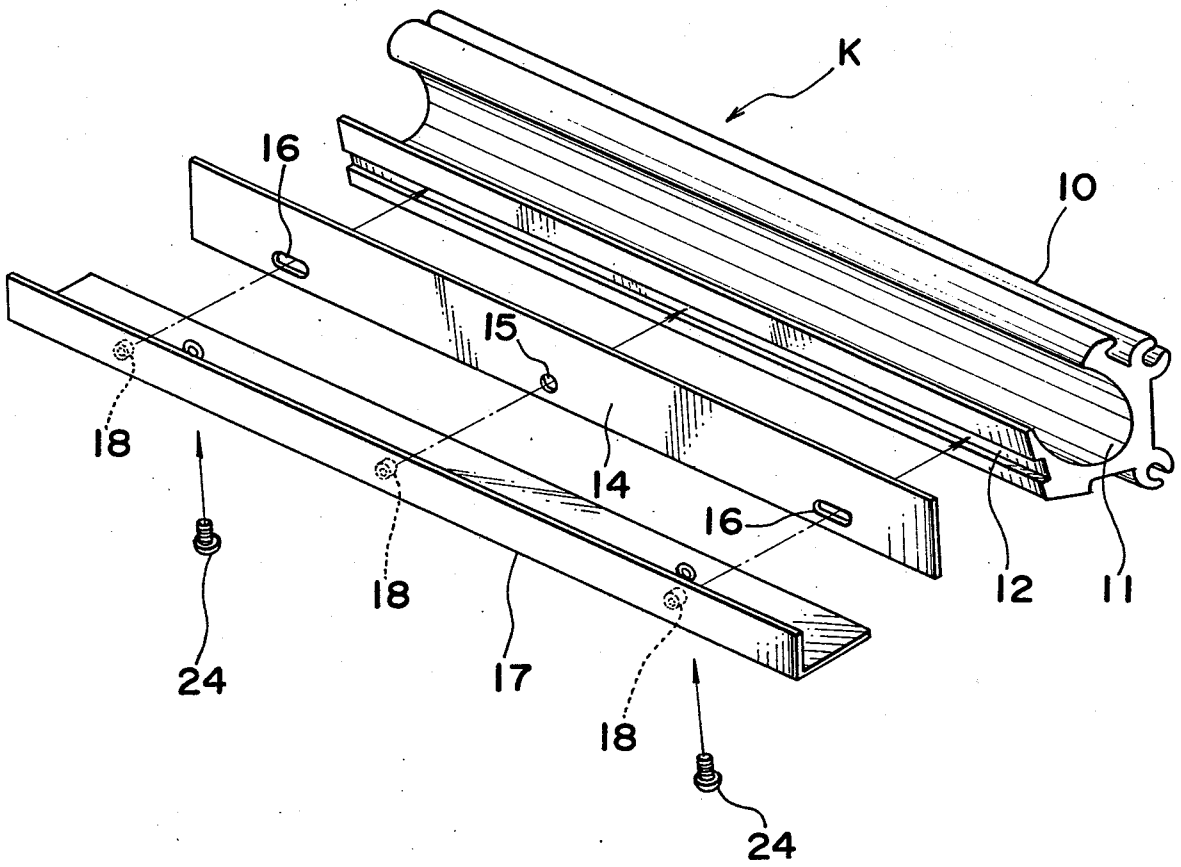
FIG. 3 is an exploded view explanatory of assembly of a toner sealing plate employed in the toner scattering prevention device of FIG. 1.
Figure 4:
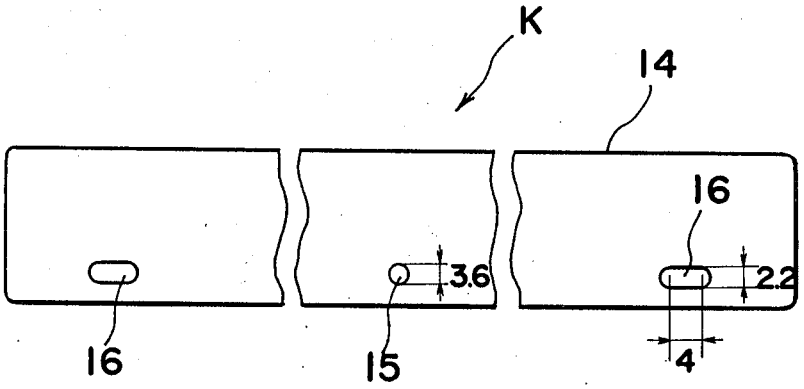
FIG. 4 is a front elevational view of the toner sealing plate of FIG. 3.
Figure 5:
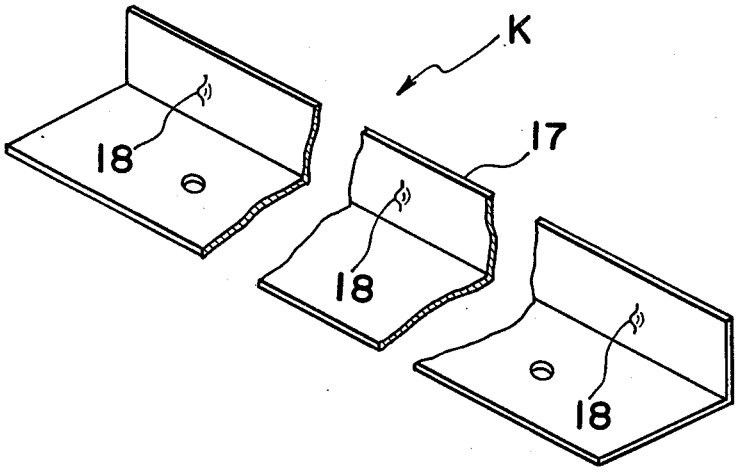
FIG. 5 is a perspective view of a retainer plate employed in the toner scattering prevention device of FIG. 1.

Referring now to the drawings, there is shown in FIGS. 1 to 5, a toner scattering prevention device K according to a first embodiment of present invention, which is applied to a cleaning device S of an electrophotographic copying apparatus. The electrophotographic copying apparatus includes a photoreceptor drum 30 which is rotatably mounted approximately at a central portion of an apparatus housing (not shown) for rotation in the counterclockwise direction in FIG. 1, and around which a developing device (not shown), the cleaning device S and other various devices are disposed along the circumference of the photoreceptor drum 30 in a known manner so as to process the surface of the photoreceptor drum 30 as the photoreceptor drum 30 rotates. The cleaning device S includes a casing 1, a pin 2, a bracket 3, a base member 6, a bolt 7, a coiled spring 8, a toner collecting casing 10, a toner transport coil 13, a cleaning blade 20, a blade holder 21 and a support screw 22. The pin 2, base member 6, bolt 7, toner collecting casing 10, toner transport coil 13, cleaning blade 20, blade holder 21 and support screw 22 are disposed in the casing 1 such that the cleaning blade 20 is held in pressing contact with the surface of the photoreceptor drum 30. Thus, residual toner scraped off the surface of the photoreceptor drum 30 by the cleaning blade 20 is returned to the developing device through rotation of the toner transport coil 13. Meanwhile, the casing 1 is mounted on the apparatus housing so as to be spaced a predetermined distance from the photoreceptor drum 30. The base member 6 is disposed in the casing 1 so as to be rotatable about the pin 2 secured to side walls of the casing 1. The cleaning blade 20 is bonded to the blade holder 21 which is pivotally mounted, at a central portion thereof, on an upper portion of the base member 6 by the support screw 22. Namely, since the cleaning blade 20 is pivotal together with the blade holder 21 about the support screw 22 and on the base member 6, a tip portion of the cleaning blade 20 is held in pressing contact with the surface of the photoreceptor drum 30 uniformly in a widthwise direction of the photoreceptor drum 30. Meanwhile, the bolt 7 is threaded into a lower portion of the base member 6 such that an end portion of the bolt 7 projects out of the casing 1 in the rightward direction in FIG. 1. The bracket 3 is secured to the casing 1 so as to be disposed outside the casing 1 such that the coiled spring 8 is provided between the bracket 3 and the end portion of the bolt 7 projecting out of the casing 1. Accordingly, the base member 6 is urged in the counterclockwise direction in FIG. 1 about the pin 2 by the coiled spring 8, whereby the tip portion of the cleaning blade 20 is brought into pressing contact with the surface of the photoreceptor drum 30. As shown in FIG. 3, the toner collecting casing 10 has an opening 11 oriented upwardly and a groove 12 formed at a front face thereof such that the opening 11 and the groove 12 extend in the widthwise direction of the photoreceptor drum 30. The toner transport coil 13 is rotatably provided in the opening 11.

The toner scattering prevention device K includes a toner sealing plate 14 made of elastic material, a retainer plate 17 formed with three projections 18, a base plate 23 and screws 24. The toner sealing plate 14 has a hole 15 formed approximately at a lower central portion and two elongated openings 16 formed at opposite sides with respect to the hole 15 in the widthwise direction of the photoreceptor drum 30, respectively. A base portion of the toner sealing plate 14 is secured to the front face of the toner collecting casing 10 by the retainer plate 17, while a tip portion of the toner sealing plate 14 is brought into light pressing contact with the surface of the photoreceptor drum 30 at an acute angle, desirably at an angle of 0° to 15° relative to the surface of photoreceptor drum 30. It is to be noted that a polyester film measuring 0.05 mm thick, 287 mm long and 20 mm wide is used as the toner sealing plate 14 in this embodiment. More specifically, as shown in FIGS. 2 and 3, the retainer plate 17 is attached to the toner collecting casing 10 by threading the screws 24 into a bottom face of the toner collecting casing 10 through the base plate 23 such that the toner sealing plate 14 is inserted into a clearance formed between the front face of the toner collecting casing 10 and the retainer plate 17. A tip portion of each of the projections 18 formed on the retainer plate 17 is arranged to pass through each of the hole 15 and the two elongated openings 16 of the toner sealing plate 14 into the groove 12 of the toner collecting casing 10. In this embodiment, each of the projections 18 has a diameter of 2 mm, while the hole 15 has a diameter of 3.6 mm and each of the elongated openings 16 is formed by a pair of semicircles of 2.2 mm in diameter spaced 4 mm away from each other in the widthwise direction of the photoreceptor drum 30. It should be noted here that a width of the clearance formed between the front face of the toner collecting casing 10 and the retainer plate 17 is made far larger than the thickness of 0.05 mm for the toner sealing plate 14 and is set at 0.3 mm in this embodiment. Namely, when the projections 18 of the retainer plate 17 are caused to pass through the hole 15 and the elongated openings 16 of the toner sealing plate 14, respectively so as to secure the toner sealing plate 14 in position, there is a play between each of the projections 18 and each of the hole 15 and the elongated openings 16, so that the toner sealing plate 14 is prevented from being displaced in the clearance in a direction at right angles to the widthwise direction of the photoreceptor drum 30 but displacement of the toner sealing plate 14 in the clearance, resulting from expansion or shrinkage of the toner sealing plate 14 in the widthwise direction of the photoreceptor drum 30 due to environmental changes, aging, etc. is allowed and thus, corrugations are positively prevented from being formed on the toner sealing plate 14.

Referring to FIG. 1, the toner sealing plate 14 is provided so as to project by a length $\alpha$ of 12.5 mm out of a tip portion of the retainer plate 17 and by a length $\beta$ of 7.5 mm out of the toner collecting casing 10, respectively.

In the above described arrangement of the toner scattering prevention device K, the photoreceptor drum 30 is rotated in the counterclockwise direction in FIG. 1 for developing and transfer processes, etc. Subsequently, the residual toner on the surface of the photoreceptor drum 30 is scraped off the surface of the photoreceptor drum 30 by a tip portion of the cleaning blade 20 so as to fall into the opening 11 of the toner collecting casing 10. And the toner fallen into the opening 11 is transported to the developing device for reuse through a toner transport pipe (not shown) by the toner transport coil 13 fitted into the opening 11. When the toner falls into the opening 11, a cloudy toner is generated and caused to remain in a space bounded by the toner collecting casing 10 and the toner sealing plate 14. However, the cloudy toner is prevented from scattering out of the casing 1 into the apparatus housing by the toner sealing plate 14. Meanwhile, although the toner sealing plate 14 is not arranged to perform a function of scraping the residual toner off the surface of the photoreceptor drum 30, deposits such as toner having a small adhesive force, dust transferred from a copy paper, etc. are sometimes scraped off the surface of the photoreceptor drum 30 by a tip portion of the toner sealing plate 14 and the deposits scraped off the surface of the photoreceptor drum 30 are collected in a recessed portion 25 formed on the base plate 23. Furthermore, the toner sealing plate 14 can be easily removed from the toner collecting casing 10 together with the retainer plate 17 and the base plate 23 by threading the screws 24 out of the toner collecting casing 10.

Figure 6:
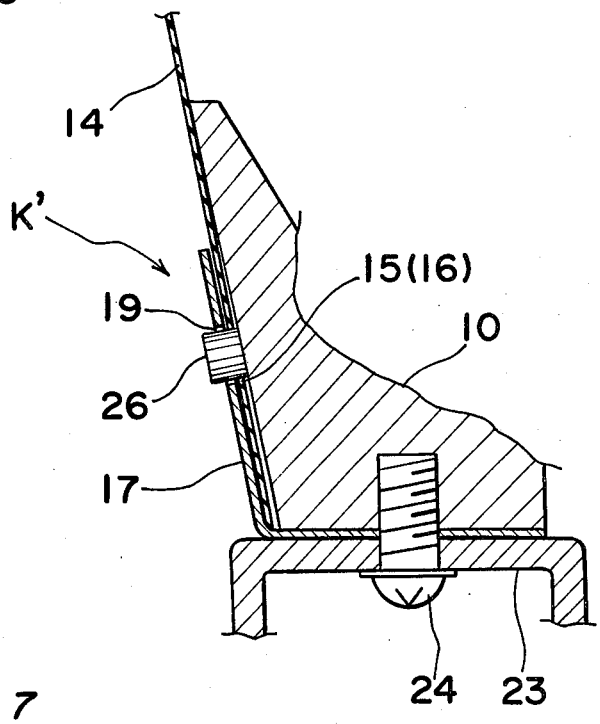
FIG. 6 is a view similar to FIG. 2, particularly showing a second embodiment thereof.

Referring now to FIG. 6, there is shown a toner scattering prevention device K' according to a second embodiment of the present invention. In the toner scattering prevention device K', it is so arranged that pins 26 provided on the front face of the toner collecting casing 10 are caused to pass through the hole 15 and the elongated openings 16 into holes 19 formed on the retainer plate 17.

Figure 7:
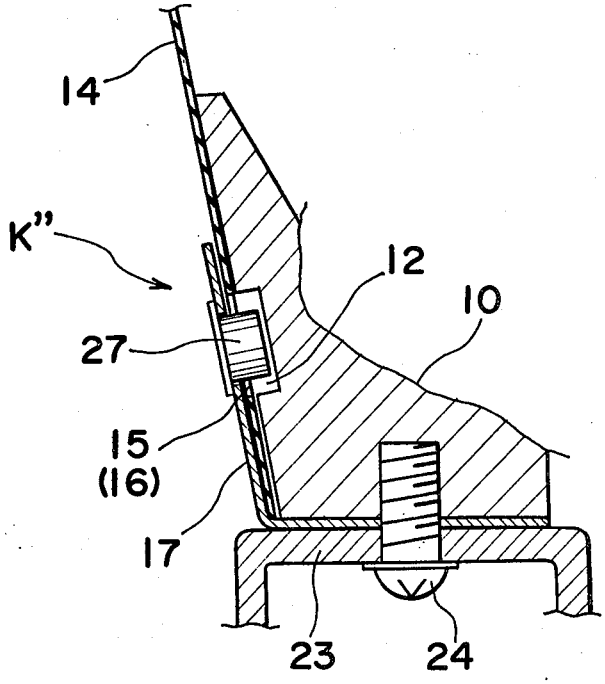
FIG. 7 is a view similar to FIG. 2, particularly showing a third embodiment thereof.

Referring further to FIG. 7, there is shown a toner scattering prevention device K" according to a third embodiment of the present invention. In the toner scattering prevention device K", it is so arranged that pins 27 secured to the retainer plate 17 are caused to pass through the hole 15 and the elongated openings 16 of the toner sealing plate 14 into the groove 12 of the toner collecting casing 10. Since other constructions of the toner scattering prevention devices K' and K" are generally the same as those of the toner scattering prevention device K, detailed description thereof is abbreviated for brevity.

It is needless to say that there is a play between each of the pins 26 and each of the hole 15 and the elongated openings 16 and between each of the pins 27 and each of the hole 15 and the elongated openings 16 in the toner scattering prevention devices K' and K", respectively so as to absorb expansion or shrinkage of the toner sealing plate 14.

Moreover, it can be so arranged that the toner sealing plate 14 is attached to an upper opening portion 1*a* (FIG. 1) of the casing 1 or an opening edge portion of the developing device casing.

As is clear from the foregoing description, in accordance with the embodiments of the present invention, the toner sealing plate is formed with the hole and the elongated openings for clamping the toner sealing plate so as to be clamped to the opening edge portion of the developing device casing or the cleaning device casing such that the projection members of the toner collecting casing or the retainer plate are caused to pass through the hole and the elongated openings. Since there is a play between each of the projection members and each of the hole and the elongated openings, the toner sealing plate is prevented from being displaced in the clearance between the toner collecting casing and the retainer plate in a direction at right angles to the widthwise direction of the photoreceptor drum but displacement of the toner sealing plate in the clearance, resulting from expansion or shrinkage of the toner sealing plate in the widthwise direction of the photoreceptor drum due to environmental changes, aging, etc. is allowed and thus, corrugations are effectively prevented from being formed on the toner sealing plate, whereby the toner can be sealed in the developing device casing or the cleaning device casing reliably at all times.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A device for preventing toner from scattering out of a developing device or a cleaning device, with said developing device and said cleaning device being provided so as to confront a surface of a toner image support member arranged to be driven for rotation, said device comprising:

a toner sealing plate of elastic material, which is brought into light pressing contact with the surface of said toner image support member;

a support member for supporting, on a support face thereof, said toner sealing plate integrally with said developing device or with said cleaning device, with said toner sealing plate extending in a widthwise direction of said toner image support member;

a clamp member for clamping said toner sealing plate, which is formed with a clamp face confronting said support face of said support member, with a clearance between said support face and said clamp face being kept larger than a thickness of said toner sealing plate;

said support face and said clamp face defining therebetween a groove for accommodating said toner sealing plate therein; and a clamp means for clamping said toner sealing plate in said groove, which prevents first displacement of said toner sealing plate in said groove and in a direction at right angles to the widthwise direction of said toner image support member but allows second displacement of said toner sealing plate in said groove, with the second displacement of said toner sealing plate resulting from expansion or shrinkage of said toner sealing plate in the widthwise direction of said toner image support member due to change in an environment surrounding said device.

2. A device as claimed in claim 1, wherein said support face of said support member and said toner sealing plate have a first clearance formed therebetween and/or said clamp face of said clamp member and said toner sealing plate have a second clearance formed therebetween.

3. A device as claimed in claim 2, wherein said clamp member is detachably mounted on said support member.

4. A device as claimed in claim 2, wherein said toner sealing plate has a plurality of holes formed in the widthwise direction of said toner image support member and in a side by side relationship with respect to each other for clamping said toner sealing plate, said clamp means being provided on said support member and/or said clamp member and being formed by projection members to be inserted into said holes, respectively, with a gap for allowing the second displacement of said toner sealing plate being formed between each of said holes and corresponding one of said projection members.

5. A device for preventing toner from scattering out of a developing device or a cleaning device, with said developing device and said cleaning device being provided so as to confront a surface of a toner image support member arranged to be driven for rotation, said device comprising:

a toner sealing plate of elastic material, which is brought into light pressing contact with the surface of said toner image support member;

a support member for supporting said toner sealing plate integrally with said developing device or with said cleaning device, with said toner sealing plate extending in a widthwise direction of said toner image support member;

said support member being formed with a groove for accommodating said toner sealing plate therein such that said groove has a clearance larger than a thickness of said toner sealing plate; and a clamp means for clamping said toner sealing plate in said groove of said support member, which prevents first displacement of said toner sealing plate in said groove and in a direction at right angles to the widthwise direction of said toner image support member but allows second displacement of said toner sealing plate in said groove, with the second displacement of said toner sealing plate resulting from expansion or shrinkage of said toner sealing plate in the widthwise direction of said toner image support member due to change in an environment surrounding said device.

6. A device as claimed in claim 5, wherein said toner sealing plate has a plurality of holes formed in the widthwise direction of said toner image support member and in a side by side relationship with respect to each other for clamping said toner sealing plate, said clamp means being provided on said support member and being formed by projection members to be inserted into said holes, respectively, with a gap for allowing the second displacement of said toner sealing plate being formed between each of said holes and corresponding one of said projection members.

* * * * *